US007984702B2

(12) United States Patent
Russell

(10) Patent No.: US 7,984,702 B2
(45) Date of Patent: Jul. 26, 2011

(54) PLUG-IN-PISTON ASSEMBLY AND METHOD OF USING THE SAME

(75) Inventor: Robert L. Russell, Frankfort, IL (US)

(73) Assignee: Russell Energy Corporation, Frankfort, IL (US)

( * ) Notice: Subject to any disclaimer, the term of this patent is extended or adjusted under 35 U.S.C. 154(b) by 499 days.

(21) Appl. No.: 12/142,999

(22) Filed: Jun. 20, 2008

(65) Prior Publication Data

US 2009/0314238 A1 Dec. 24, 2009

(51) Int. Cl.
*F02P 15/04* (2006.01)
*F02B 53/12* (2006.01)

(52) U.S. Cl. ..... 123/162; 123/210; 123/45 R

(58) Field of Classification Search ..... 123/210, 123/45 R, 45 A, 151, 162
See application file for complete search history.

(56) References Cited

U.S. PATENT DOCUMENTS

| | | | | |
|---|---|---|---|---|
| 1,700,554 | A * | 1/1929 | Wagner | 123/162 |
| 2,073,985 | A * | 3/1937 | Collins | 123/162 |
| 2,253,203 | A * | 8/1941 | Di Lucci | 123/162 |
| 2,253,204 | A * | 8/1941 | Di Lucci | 123/162 |
| 2,988,065 | A | 6/1961 | Wankel et al. | |
| 3,762,377 | A | 10/1973 | Anthony et al. | |
| 3,893,430 | A | 7/1975 | Burley | |
| 3,952,708 | A | 4/1976 | Burley | |
| 3,987,758 | A | 10/1976 | Wankel | |
| 4,095,564 | A | 6/1978 | Hochstein | |
| 6,230,670 | B1 | 5/2001 | Russell | |
| 7,281,513 | B1 | 10/2007 | Webb | |
| 2004/0221823 | A1 * | 11/2004 | Warren | 123/45 R |

* cited by examiner

*Primary Examiner* — Willis R Wolfe, Jr.
(74) *Attorney, Agent, or Firm* — Ladas & Parry LLP

(57) ABSTRACT

The combination of a piston with an integrated spark plug to be used in an internal combustion engine is disclosed. The plug-in-piston configuration allows for maximum combustion and fuel efficiency as well as increased power output. Further, the configuration minimizes the release of unburned fuel and pollutants into the atmosphere. A method is also disclosed by which electrical energy is communicated to a spark plug.

20 Claims, 7 Drawing Sheets

PLUG-IN-PISTON ASSEMBLY AND METHOD OF USING THE SAME

BACKGROUND OF THE INVENTION

This invention relates generally to internal combustion engines and, more particularly, to an improved combustion environment within the cylinders in rotary engines employing reciprocating pistons.

In the familiar internal combustion engine, as well as in the familiar rotary piston type internal combustion engine, the spark plug is typically located in the stationary head of the engine. This configuration provides for the ignition of an air-fuel mixture within the cylinder at the point of the spark plug. The ignition of these gasses can be best described as a rapid burn originating at the point of the spark plug and growing out from that point towards the outward moving piston face. During high-speed operation the speed of the piston can exceed the speed of the burn. When this happens the burn is not yet completed when the exhaust valve opens and the unburned fuel is then expelled into the atmosphere wasting fuel and energy as well as producing higher than normal levels of pollution. On the other hand it is known that high-speed movement of the piston can help control the production of nitrogen oxides (other pollutants). Therefore, a need has developed to have a combination of high-speed piston movement with a more complete combustion.

This invention seeks to address the problem of unburned gasses being expelled into the atmosphere because of uncompleted combustion cycles during the high-speed operation of an internal combustion engine. It further seeks to provide conditions where high-speed piston movement is encouraged during combustion to help control the formation of nitrogen oxides and thereby further reduce toxic emissions. It is yet another goal of this invention to provide a means by which more usable energy can be provided because of a more complete combustion burn cycle, thereby increasing fuel efficiency and reducing fuel usage.

SUMMARY OF THE INVENTION

In contrast to conventional internal combustion engine configurations where the spark plug is located in the stationary engine head, the present invention provides a combined piston and spark plug configuration, hereinafter referred to as plug-in-piston assembly, where the spark plug is attached to and moves in unison with the piston. By initiating the combustion burn from the piston face, as is the purpose of the plug-in-piston design, the burn will now emanate from the movable piston face at a time when the piston is relatively stationary and be directed towards the stationary head of the engine allowing the flame to more completely consume all of the fuel in the cylinder prior to the opening of the exhaust valve. This single action will allow much higher acceleration rates for the piston while providing more complete combustion of the air-fuel mixture increasing output power while reducing fuel consumption and exhaust emissions.

It is therefore the intention of at least one aspect of the invention to provide a plug-in-piston assembly having a novel combination of a piston and spark plug.

In one aspect, the plug-in-piston assembly may include a spark plug threadably attached to and capable of moving in unison with the piston.

In another aspect, the plug-in-piston assembly may include a piston connected to a cylinder sleeve by a wrist pin whereby the wrist pin passes through a cylinder wall. The wrist pin has a tubular configuration and an angular hole provided at its center. There may also be an insulated spark plug body threadably attached to the piston and a spark plug electrode running through it. This electrode extends from the insulated spark plug body to the outside of the wrist pin and is aligned with a wrist pin electrode. The wrist pin electrode may be received through the angular hole on the wrist pin and may extend to lateral ends of the wrist pin. A stationary spark plug located on the stationary outer case transmits electrical energy, which may be received by the wrist pin electrode.

Still another aspect of the present invention may provide a plug-in-piston assembly including a piston having a bore. The bore is used to receive an insulating tube and a head of the spark plug is disposed in said insulating tube.

Another intention of at least one aspect of the invention is to provide an internal combustion engine having a central rotor supporting a plurality of radially extending cylinders rotatable with said rotor about a stationary main shaft. There is also a piston located within the interior surface of each of said cylinders and a spark plug that is attached to and moves in unison with each piston. The piston reciprocates in bearing relation with the interior surface of the cylinder and has a spark plug electrode running through it which extends from the spark plug to the wrist pin. The spark plug electrode is in alignment with the wrist pin electrode. A stationary case having an upper and lower half surrounds the engine coaxially of the stationary main shaft and a pair of cam tracks formed integrally with opposing interior walls is located therein. There is also a pair of cam follower bearings associated with each piston and each bearing operationally engages an adjacent one of the cam tracks whereby combustion actuation of each piston serves to drive the cam followers along said cam tracks.

Another intention of certain aspects of the present invention may be to provide a plug-in-piston assembly for the purpose of initiating a rapid air-fuel burn in a cylinder originating from the face of a movable piston and expanding outward towards the stationary head of the engine.

Yet another intention of certain aspects of the present invention may be to provide a plug-in-piston assembly that allows for a higher and more complete consumption of fuel when compared to a conventional internal combustion engine where the spark plug is located in the stationary engine head.

A further intention of at least one aspect of the present invention may be to provide a plug-in-piston assembly that provides increased power output with reduced fuel consumption when compared to a conventional internal combustion engine where the spark plug is located in the stationary engine head.

Still another intention of certain aspects of the present invention may be to provide a plug-in-piston assembly that produces fewer pollutants as a result of improved combustion when compared to a conventional internal combustion engine where the spark plug is located in the stationary engine head.

Another intention of at least one aspect of the present invention may be to provide a plug-in-piston assembly that can energize the spark plug while it is in motion with the piston.

A further intention of certain aspects of the present invention may be to provide a plug-in-piston assembly that energizes the spark plug while it is in motion with the cylinder.

Finally, another intention of certain aspects of the present invention may be to provide a method of initiating combustion in an internal combustion engine including the steps of providing a spark plug attached to a piston, providing a wrist pin electrode connected to the piston electronically connecting the wrist pin electrode to a spark plug electrode. A further step includes electrically connecting a spark plug electrode to a spark plug and transmitting electrical energy to the wrist pin electrode to produce a spark at the spark plug within the confines of a cylinder thereby initiating combustion. This method may also include the step of providing a second stationary spark plug which transmits electrical energy to the wrist pin electrode.

Having described certain aspects of the present invention, the above and further objects, features and advantages thereof will become readily apparent to those skilled in the art from the following detailed description and illustrations in the accompanying drawing figures.

BRIEF DESCRIPTION OF THE DRAWING FIGURES

DETAILED DESCRIPTION OF THE PREFERRED EMBODIMENT

A preferred embodiment of a combined piston and spark plug configuration where the spark plug is threadably attached to and moves in unison with the piston will now be described. Although the preferred embodiment provides for the spark plug being threadably attached to the piston, various other conventional means for attaching the spark plug to the piston are acceptable.

In a preferred embodiment disclosed herein, the unitary piston body has an integral connecting rod and an enlarged end at the back or the end opposite of the piston face that is receptive of a transverse wrist pin. A hole is bored and threaded in the face of the piston and on the centerline of the piston to receive the spark plug. An additional hole is bored on the centerline of and through the integral piston connecting rod from the back of the spark plug seat to the transverse bore in the back of the piston provided to receive the transverse wrist pin. This hole through the core of the piston is provided to receive the spark plug electrode and a suitable insulating material. The wrist pin is of a tubular configuration with an angular hole provided at the longitudinal center of the wrist pin and in alignment with the centerline of the wrist pin. This hole is provided to receive the pre-formed end of the wrist pin electrode, which will be in concentric alignment with the spark plug electrode after assembly. The wrist pin electrode is pre-formed with one bent end to align with the spark plug electrode and one expanded end located at one of the longitudinal ends of the wrist pin. In a particular aspect of the present invention where multiple sparks are desired in close proximity, the wrist pin electrode can be made to extend to both ends of the wrist pin. The wrist pin electrode is located along the longitudinal centerline of the wrist pin and secured by a suitable insulating material.

The expanded end of the wrist pin electrode is provided to receive a first spark, which is transmitted from a stationary modified spark plug of a more standard configuration located in the stationary outer case. The electrical energy transmitted from the first spark is carried through the wrist pin electrode to the spark plug electrode producing the desired spark at the point of the spark plug located at the piston face within the confines of the cylinder. The piston is located within the cylinder to reciprocate coaxially thereof in bearing relation with the cylinder's interior surface. The wrist pin extends through slotted openings in the cylinder walls and is coupled to a cam driven yoke or sleeve located exteriorly of the cylinder. The yoke has a cylindrical body, which embraces and rides in bearing relation with the smooth ground exterior of the cylinder during reciprocating activity of the piston.

Figure 1:
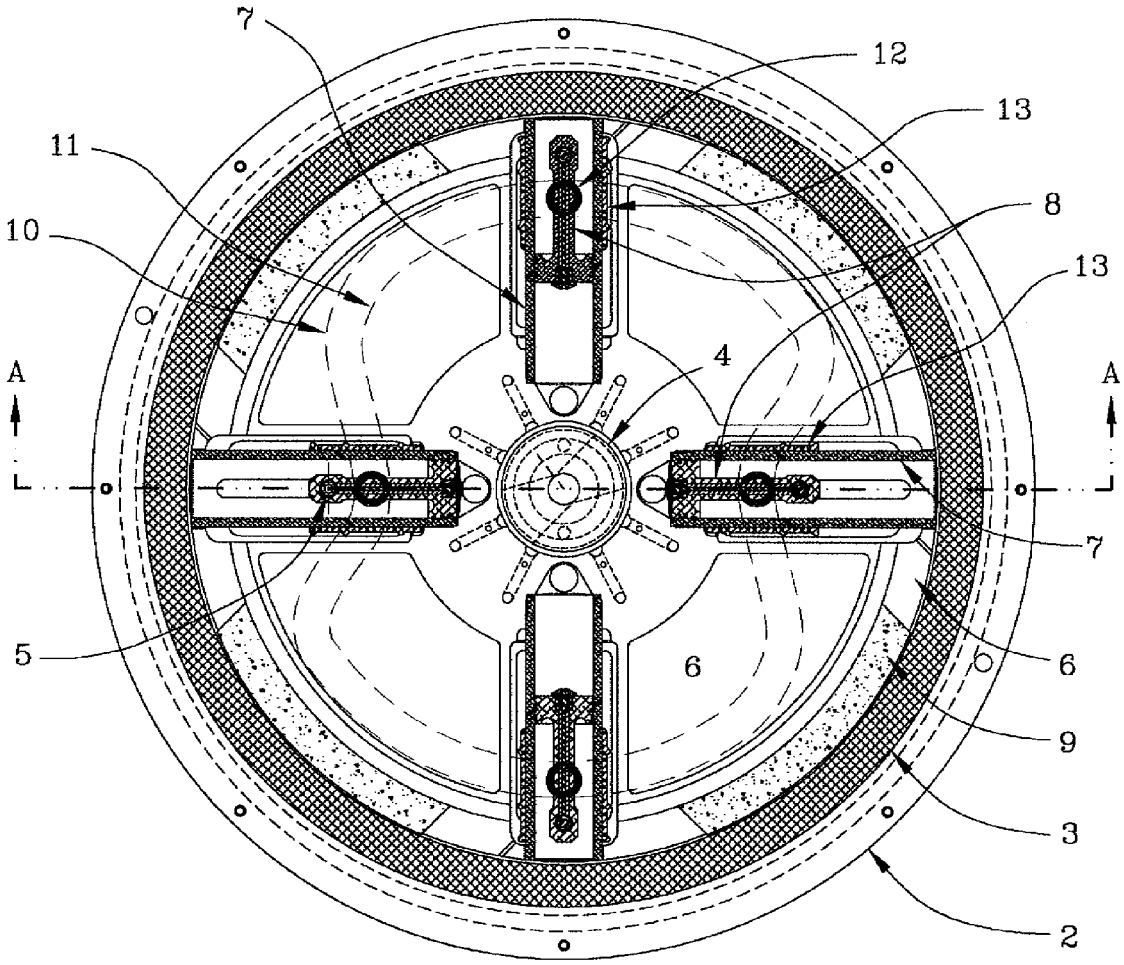
FIG. 1 is a top elevational view of an assembled rotary engine/generator combination with the top case removed showing the cylinders and pistons of the engine in cross-sectional views.

Turning now to the drawing figures, FIG. 1 is a top view of a rotary engine/generator design having the general features and characteristics of U.S. Pat. No. 6,230,670, the contents of which are hereby incorporated by reference in their entirety. In FIG. 1, the top view of the engine/generator is shown with the upper case half 1 removed. Also shown is the stationary lower case half 2 and the stationary electrical generating coil 3 that is attached to the case halves. Further depicted is the stationary main shaft 4 around which the rotor 6 rotates with the cylinders 7 and the pistons 8 causing the permanent magnets 9 to move rotationally in close proximity to the stationary coil 3 thereby producing electrical energy. Although the upper case 1 is not shown in FIG. 1, the positions of one of the two stationary first spark plugs 5, the outer cam track 10 and the inner cam track I 1 are visible. The cam tracks 10 and 11 are used to move and harness the power of the pistons 8 during operation through their interaction with the cam follower bearings 12 mounted to the cylinder sleeves 13.

Figure 2:
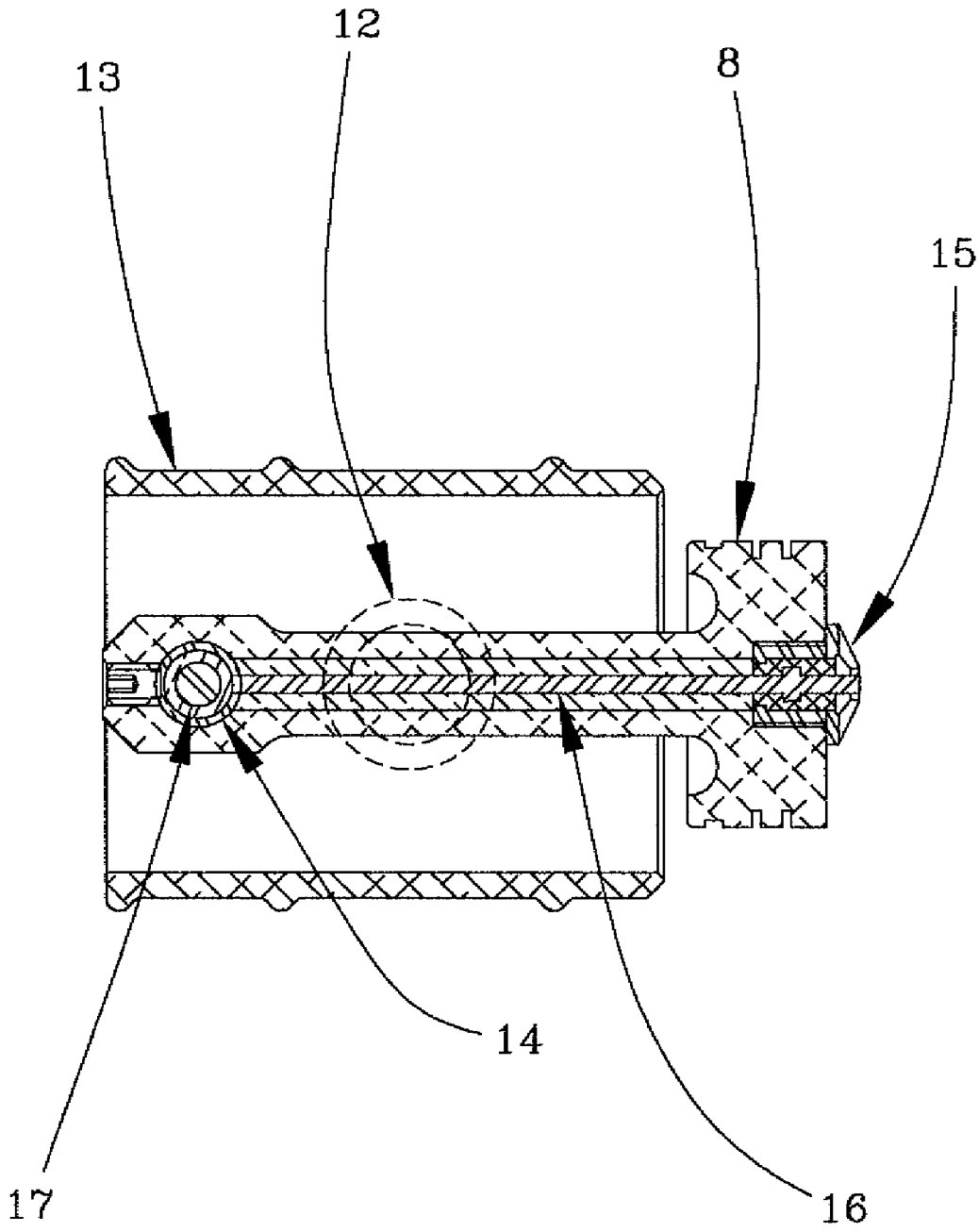
FIG. 2 is an enlarged sectional top view of the plug-in-piston assembly with sleeve as seen in FIG. 1.

FIG. 2 is an enlarged sectional top view of the plug-in-piston assembly with the cylinder sleeve 13 as seen in FIG. 1. In FIG. 2 the cylinder sleeve 13 and the cam follower bearing 12 that travel along the outer diameter of the cylinders 7 (not shown in this view) can be seen as well as the wrist pin 14 which is used to connect the piston 8 to the cylinder sleeve 13. Threadably attached to the face of the piston 8 is the insulated spark plug body 15. Running through the piston 8 body is the spark plug electrode 16, which extends from the furthest point of the insulated spark plug body 15 to the outside diameter of the wrist pin 14 where it comes into an insulated alignment with the wrist pin electrode 17. This arrangement is described in greater detail below.

Figure 3:
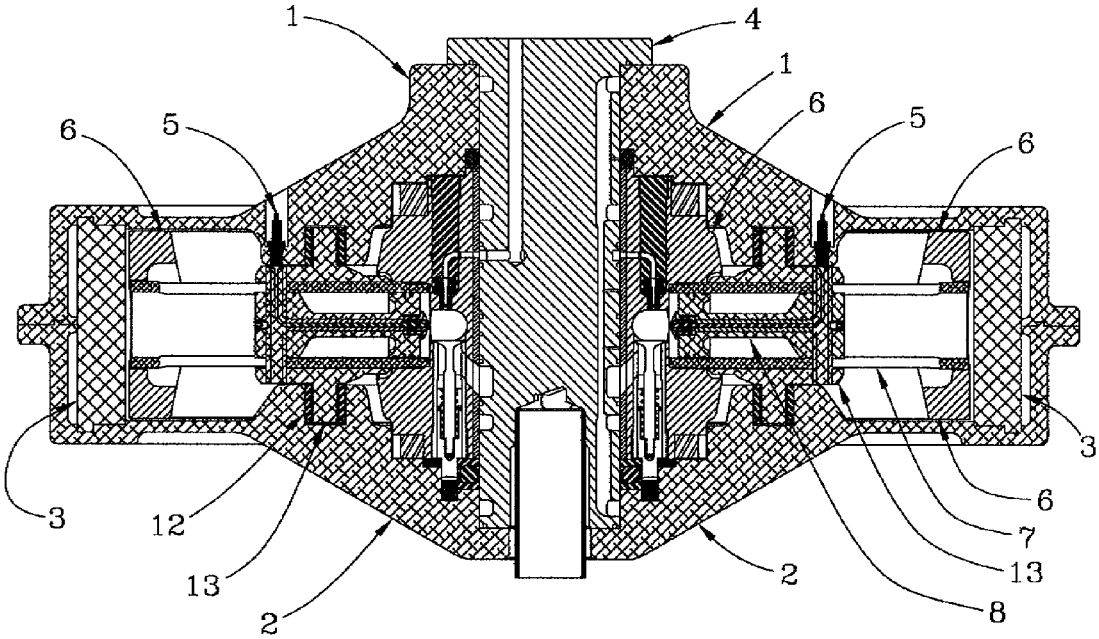
FIG. 3 is a full cross-section view taken substantially along section line A-A of FIG. 1 to illustrate the side elevation of the assembled arrangement of the parts therein.

FIG. 3 is a full side cross-section view taken substantially along section line A-A of FIG. 1 to illustrate the side elevation of the assembled arrangement of the parts therein. In this view the stationary top case half 1 can be seen as well as the stationary lower case half 2, the stationary coil 3, the stationary main shaft 4 and the two stationary first spark plugs 5. The rotor 6 that rotates around the main shaft 4 with the cylinders 7 and the cylinder sleeves 13 can also be seen with the pistons 8 in the cylinders 7. The cam follower bearings 12 that are mounted to the cylinder sleeves 13 are also shown in this view.

Figure 4:
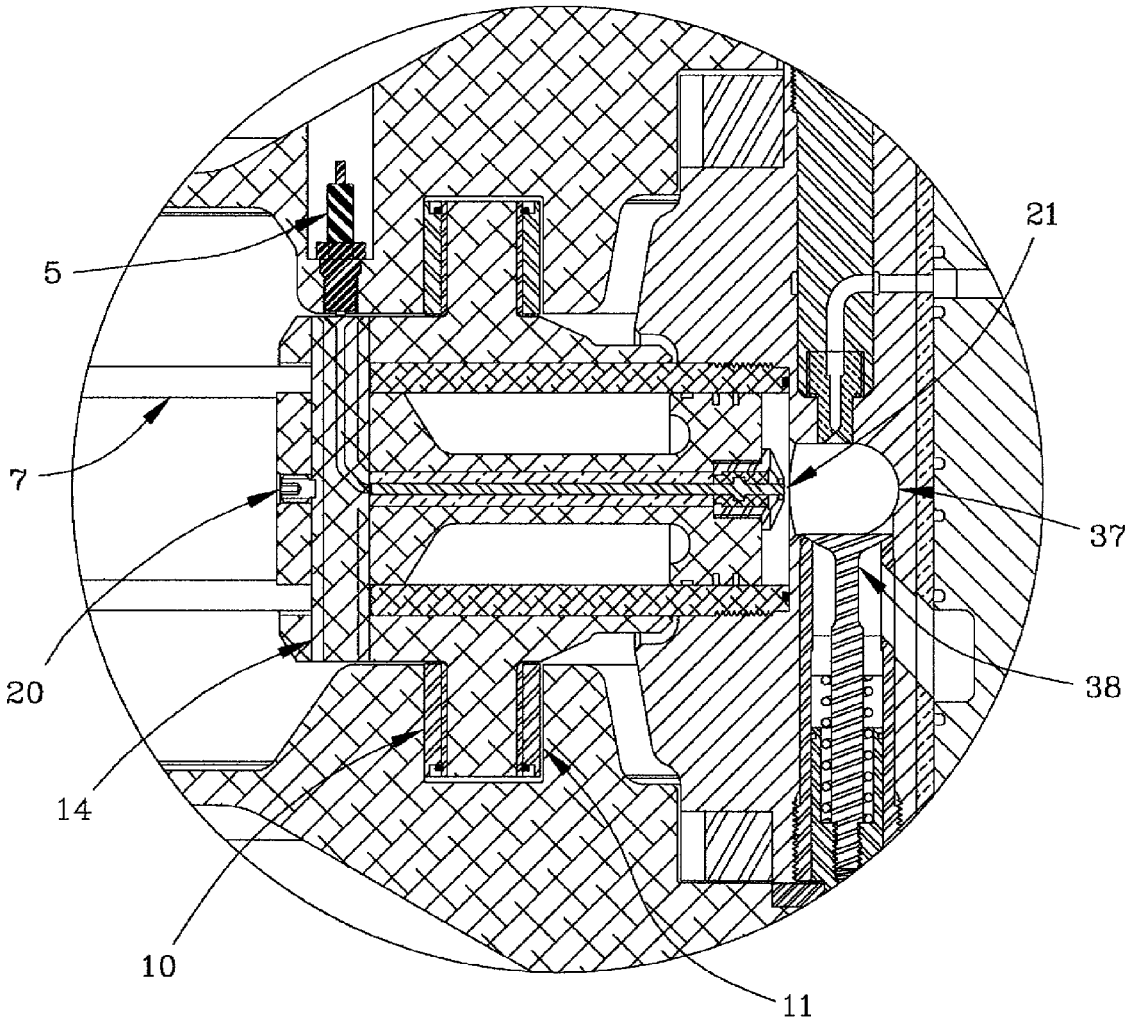
FIG. 4 is an enlarged side section view as seen in FIG. 3 to illustrate the assembled arrangement of the plug-in-piston assembly.

FIG. 4 is an enlarged side section view, as seen in FIG. 3, to illustrate the assembled arrangement of the plug-in-piston assembly. In FIG. 4 the relationship is shown between the wrist pin 14 as it passes through the slotted walls of the cylinder 7 and is held in place by the set screw 20. Also depicted is the outer earn track 10 and the inner cam track 11 used to control and harnesses the motion of the piston assembly. In this view, the point of ignition 21 is clearly visible as is the farthest point of the stationary head 37. When the ignition starts at the piston face and the piston begins to rapidly move away from the head, the flame or burn will continue to move towards the stationary head and point 37 completing the burn before the exhaust valve 38 opens.

Figure 5:
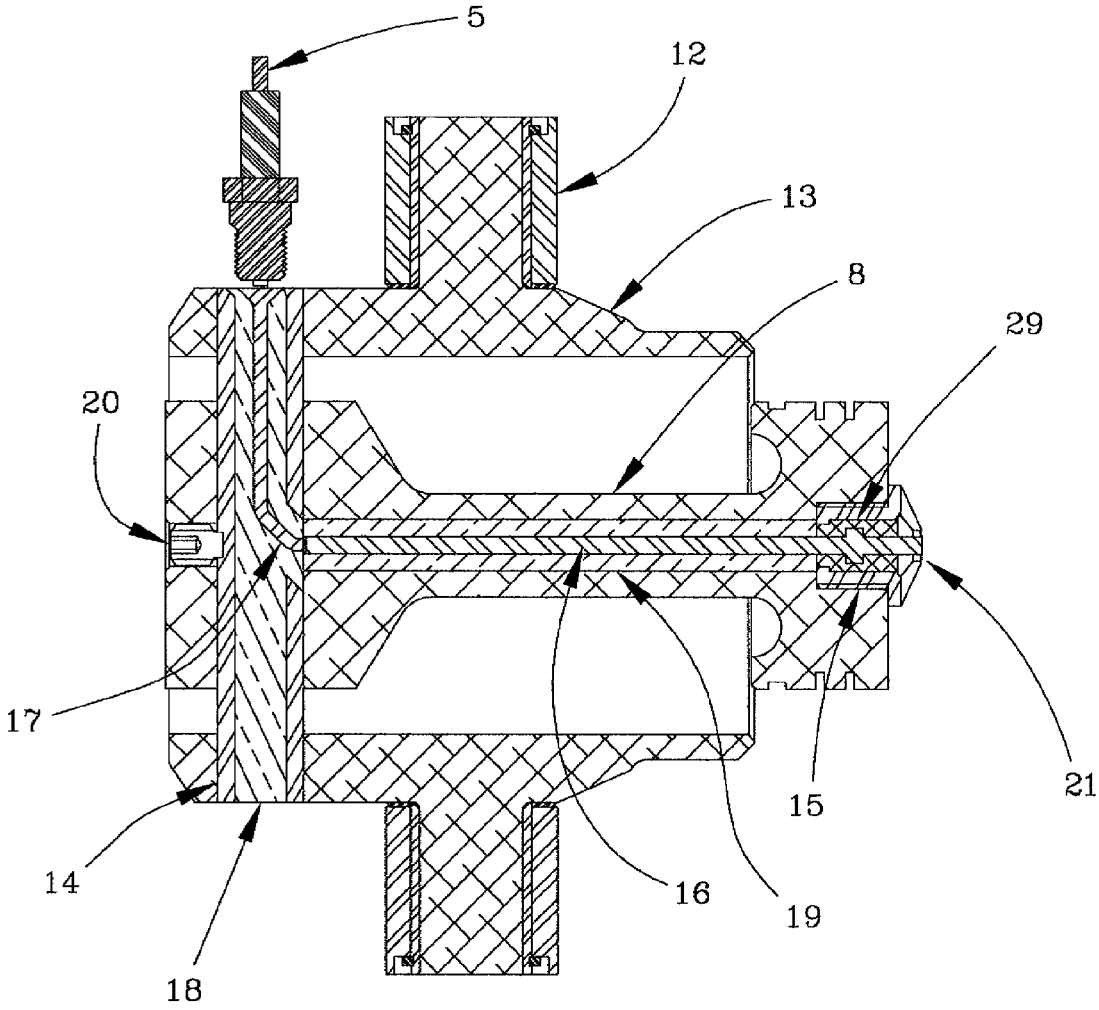
FIG. 5 is a further enlarged side section view of the Plug-In-Piston assembly as seen in FIG. 4 showing only the plug-in-piston components.

FIG. 5 is a further enlarged side section view of the plug-in-piston assembly as seen in FIG. 4 showing only the plug-in-piston components. It includes the first spark plug 5, which provides the means to jump a spark to the wrist pin electrode 17, which passes the current to the end of the spark plug electrode 16 causing a final spark to be produced at the tip 21 of the spark plug body 15 within the cylinder 7, thereby initiating combustion. The wrist pin electrode 17 is fully insulated from the wrist pin 14 by the insulating material 18. The piston 8 is fully insulated from the spark plug electrode 16 by the insulating tube 19 and the spark plug body 15 is fully insulated from the spark plug electrode 16 by a suitable insulating material 29. The set screw 20 rests in a slot in the wrist pin 14 insuring proper alignment and positioning of the electrodes 17 and 16.

Figure 6:
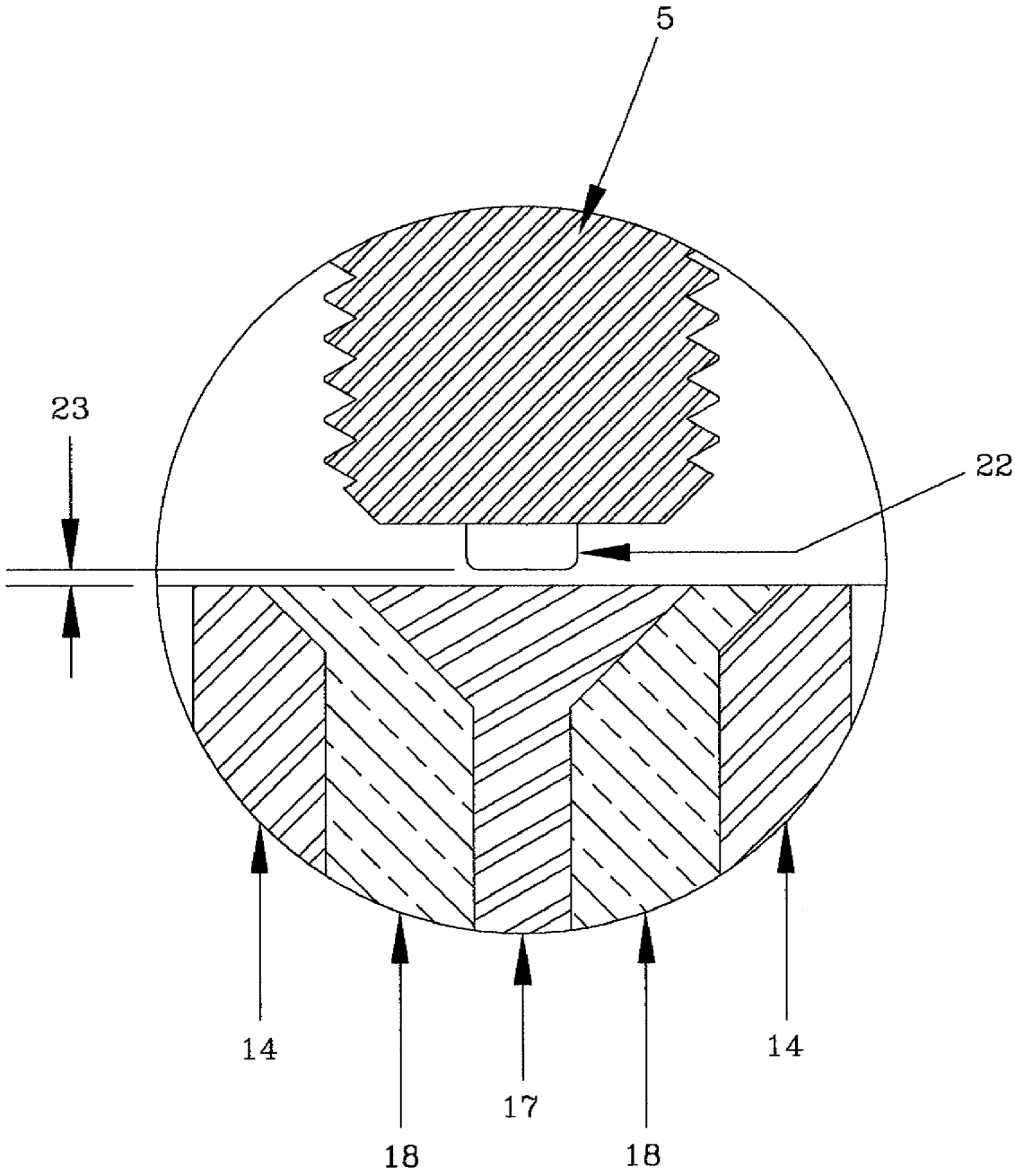
FIG. 6 is an enlarged side section view of in FIG. 5.

FIG. 6 is an enlarged side section view of FIG. 5. In this view, the relationship between the stationary first spark plug 5 and the moving wrist pin 14 when it is in alignment at the time of ignition is shown. Also depicted is the electrode 22, which is part of the first spark plug 5. It is from this electrode 22 in the first spark plug 5 that the first spark is jumped across the gap 23 energizing the wrist pin electrode 17 ultimately causing ignition of the air-fuel mixture within the related cylinder 7. The wrist pin insulating material 18 is also visible in this view.

Figure 7:
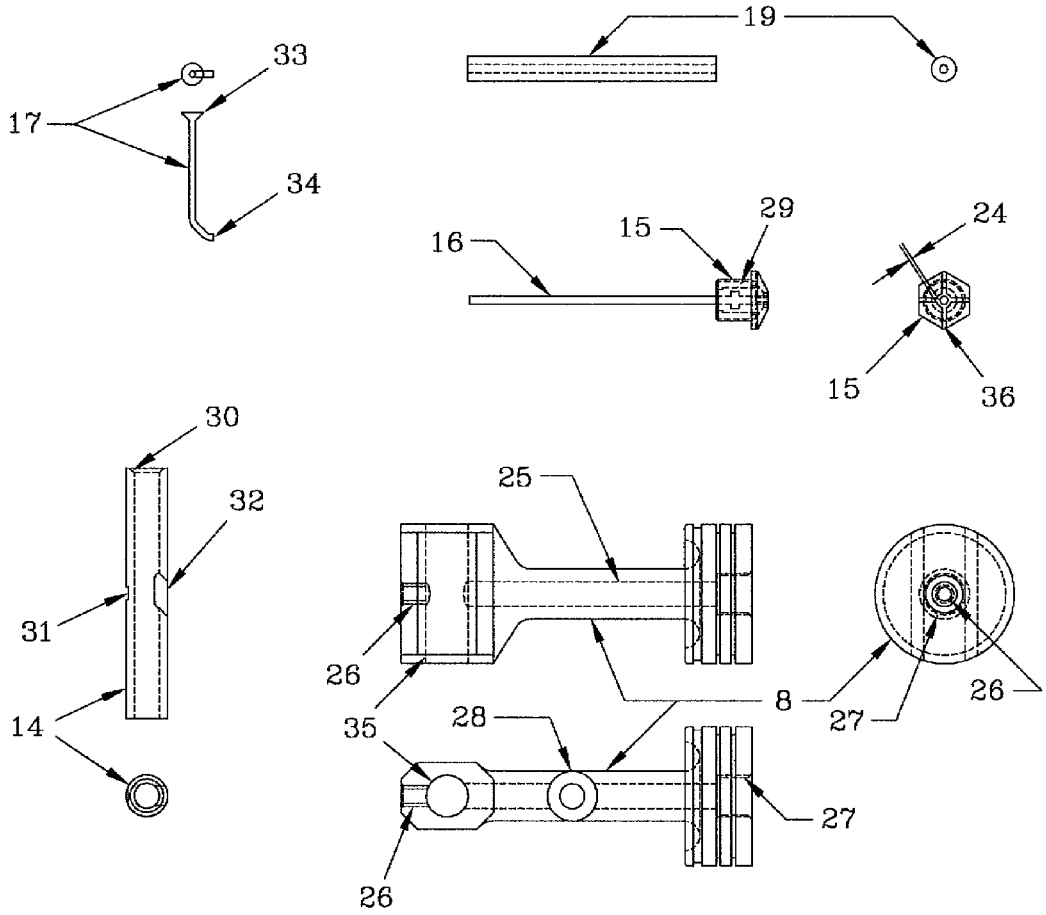
FIG. 7 is an illustration of the component parts of the plug-in-piston and wrist pin with electrode shown in multiple views.

FIG. 7 is a component parts break down of the plug-in-piston and wrist pin 14 with the wrist pin electrode 17 shown in multiple views. Viewing in a clockwise rotation starting with the wrist pin 14 which is shown in two views, it is clear that the wrist pin 14 is of a tubular configuration having an angular relief 30 formed on one end of the inside bore, a locating notch 31 used to locate and secure the wrist pin 14 in the transverse bore 35 of the piston 8 and an angular slot 32 provided to receive the angular bent end 34 of the wrist pin electrode 17. The wrist pin electrode 17 can be seen with the expanded head 33 and the bent end 34.

The insulating tube 19 is also shown in two views. It is of such size that the outside diameter will be accepted by the bore 25 of the piston 8 and the inside bore of the insulating tube 19 will be receptive of the spark plug electrode 16 fitting firmly between the spark plug head 15 and the wrist pin 14 in assembly. The spark plug head 15 can be seen with insulating material 29 holding the spark plug electrode 16 in a non-conductive position away from the spark plug head 15. The insulating material 29 provides a closer uniform proximity for the spark to jump, referred to as a spark gap 24, from the spark plug electrode 16 to the spark plug head 15 during ignition. Four vents 36 are cut into and across the spark plug head 15 to provide for better combustion and vitalization.

Finally, the piston 8 is shown with a bore 25 being receptive of the insulating tube 19 and a threaded bore 27 being receptive of the spark plug assembly. The assembly comprises the spark plug electrode 16 and the spark plug head 15 which is inserted into the insulating tube 19 and threadably attached to the piston face at the threaded bore 27. Also shown is a threaded hole 26 being receptive of a set screw 20 (see FIG. 5) to locate and secure the wrist pin 14 in assembly and a cross-sectional view 28, showing the cylindrical nature of the piston 8 body.

From the foregoing, it is believed that one of skill in the art will readily recognize and appreciate the novel advancement of this invention over the prior art and will understand that while the same has been described herein and associated with preferred illustrated embodiments thereof, the same is nevertheless susceptible to variation, modification and substitution of equivalents without departing from the spirit and scope of the invention which is intended to be unlimited by the foregoing except as may appear in the following appended claims.

What is claimed is:

1. A plug-in-piston assembly comprising:

a stationary housing defining a chamber into which a gas is introduced;

a reciprocating piston mounted for reciprocation within the chamber of the housing, the piston having a surface that forms a seal with the chamber and that, when moving in a direction within the housing, reduces the volume of the chamber between the surface and the housing; and a spark plug which is attached to the surface of the reciprocating piston and moves in unison with the piston.

2. A method of initiating combustion in an internal combustion engine comprising the steps of:

providing a spark plug attached to a piston;

providing a wrist pin electrode connected to said piston electrically connecting said wrist pin electrode to a spark plug electrode;

electrically connecting said spark plug electrode to said spark plug; and transmitting electrical energy to the wrist pin electrode to produce a spark at the spark plug within the confines of a cylinder thereby initiating combustion.

3. The method of claim 2, further comprising the step of providing a second stationary spark plug which transmits electrical energy to said wrist pin electrode

4. An internal combustion engine, comprising:

a central rotor supporting a plurality of radially extending cylinders rotatable with said rotor about a stationary main shaft;

a piston located within an interior surface of each of said cylinders;

a spark plug which is attached to and moves in unison with said piston;

a stationary case with an upper half and a lower half surrounding said engine coaxially of said stationary main shaft;

a pair of cam tracks formed integrally with opposing interior walls of said stationary case; and a pair of cam follower bearings associated with each said piston, each cam follower bearing operationally engaging an adjacent one of said cam tracks whereby combustion actuation of each piston serves to drive said cam followers along said cam tracks.

5. The internal combustion engine of claim 4, wherein said piston reciprocates in bearing relation with said interior surface of said cylinder.

6. The internal combustion engine of claim 4, further comprising a spark plug electrode running through said piston and extending from said spark plug to said wrist pin.

7. The internal combustion engine of claim 6, wherein said spark plug electrode is in alignment with a wrist pin electrode.

8. A plug-in-piston assembly comprising:

a piston; and a spark plug which is attached to and moves in unison with said piston, wherein said spark plug is threadably attached to said piston.

9. The plug-in-piston assembly of claim 8, wherein said spark plug is insulated.

10. The plug-in-piston assembly of claim 9, wherein:

said piston has a bore;

said bore receives an insulating tube; and a head of said spark plug is disposed in said insulating tube.

11. The plug-in-piston assembly of claim 8, wherein said piston is connected to a cylinder sleeve by a wrist pin.

12. The plug-in-piston assembly of claim 11, wherein said wrist pin passes through a wall of said cylinder sleeve and is held in place by a set screw.

13. The plug-in-piston assembly of claim 11, wherein said wrist pin comprises a tubular configuration having an angular hole provided at the center of said wrist pin.

14. The plug-in-piston assembly of claim 13, wherein said angular hole receives said wrist pin electrode.

15. The plug-in-piston assembly of claim 11, further comprising a spark plug electrode running through said piston and extending from said spark plug to said wrist pin.

16. The plug-in-piston assembly of claim 15, wherein said spark plug electrode is insulated.

17. The plug-in-piston assembly of claim 15, wherein said spark plug electrode is in alignment with a wrist pin electrode.

18. The plug-in-piston assembly of claim 17, wherein said wrist pin electrode extends to lateral ends of said wrist pin.

19. The plug-in-piston assembly of claim 17, wherein said wrist pin electrode receives electrical energy from a stationary spark plug.

20. The plug-in-piston assembly of claim 19, wherein said stationary spark plug is located in a stationary outer case.

* * * * *